United States Patent [19]

Kao

[11] Patent Number: 4,835,665

[45] Date of Patent: May 30, 1989

[54] EMERGENCY FLASHLIGHT

[76] Inventor: Fon-San Kao, 1st Fl., No. 21, Lane 475, Hsin Ming Road, Nei-Hu District, Taipei, Taiwan

[21] Appl. No.: 203,827

[22] Filed: Jun. 8, 1988

[51] Int. Cl.[4] ..... F21L 7/00

[52] U.S. Cl. ..... 362/184; 362/208; 362/234; 362/253

[58] Field of Search ..... 362/157, 184, 205, 208, 362/234, 253, 457, 458

[56] References Cited

U.S. PATENT DOCUMENTS

| | | | |
|---|---|---|---|
| 2,716,700 | 8/1955 | La France | 362/184 |
| 4,446,509 | 5/1984 | Thomas | 362/184 |
| 4,703,402 | 10/1987 | Hsieh | 362/253 X |

*Primary Examiner*—Stephen F. Husar

[57] ABSTRACT

A flashlight having a compass and a detection box on its front end. The detection box has an auxiliary battery inside of it which operates separately from the main dry cell batteries of the flashlight. The auxiliary battery activates a sounder to emit beeping or buzzing noise and simultaneously activates a user lamp to flash short bursts of bright light when the control switch of the detection box is switched on.

1 Claim, 2 Drawing Sheets

EMERGENCY FLASHLIGHT

BACKGROUND OF THE INVENTION

This invention relates to flashlights, and in particular relates to flashlights which can also be used in emergency situations such as when lost in a wooded area.

It is the purpose of this present invention, therefore, to mitigate and/or obviate the above-mentioned drawbacks in the manner set forth in the detailed description of the preferred embodiment.

SUMMARY OF THE INVENTION

This invention relates to improvements in a flashlight comprising a housing, a main lamp, an ON/OFF switch, and dry cell batteries. The improvement comprises the combination of:

(a) An enclosed detection box which is fixed on an outer front surface of the housing of the flashlight; and (b) a compass fixed on the outer front surface of the housing of the flashlight for determining the direction in which said flashlight is pointing.

The detection box includes a user lamp, a sounder, an auxiliary battery and a control switch therein. The auxiliary battery drives a frequency generator which in turns causes a sounder to emit a beeping or buzzing noise. The auxiliary battery also drives a flashing circuit which in turn drives a user lamp to flash bright bursts of light for short periods of time. The frequency generator and the flashing circuit are in parallel with each other so that when the ON/OFF switch is switched on, both the sounder and the flashing user lamp are activated in order to attract the attention of rescue personnel or the like.

A primary objective of this invention is to provide an emergency flashlight which can be used in survival or emergency situations.

Another objective of this invention is to provide an emergency flashlight with a compass thereon for convenience and enhanced usability.

A further objective of this invention is to provide an emergency flashlight with a sounder or beeper thereon and a "flasher" lamp.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
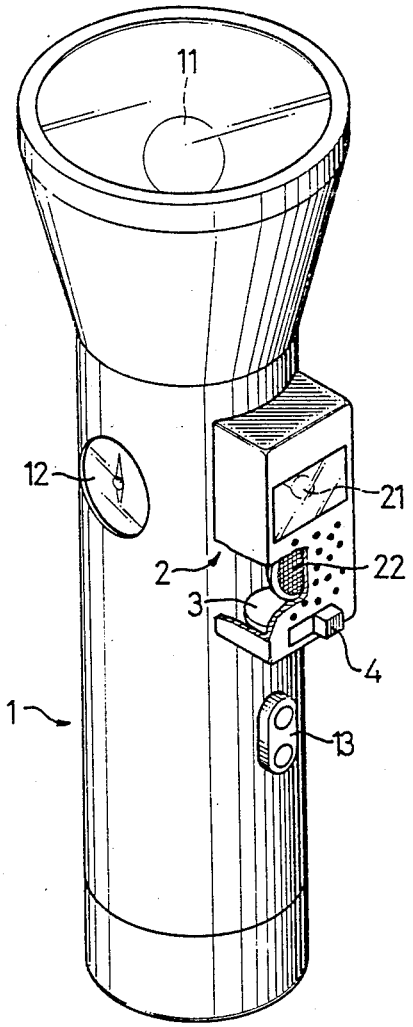
FIG. 1 is a perspective view of an emergency flashlight in accordance with the present invention.

Referring to FIG. 1, it can be seen that the present invention comprises the combination of a housing 1, a main lamp 11, a compass 12, a main lamp ON/OFF switch and a detection box 2.

The detection box 2 includes a user lamp 21, a buzzer 22, a detection box battery 23 (preferably lithium battery), and a detection box control switch 24. It should be noted that the detection box 2 and all its components operate independently of the main lamp 11 of the flashlight and are powered by a small auxiliary battery 23 inside the detection box 2.

Basically, the detection box 2 is designed for use in survival and detection situations, such as when a person is lost in a forest or is stranded on a boat, etc. When the detection box control switch 24 is switched on, the sounder 22 and the user lamp 21 are activated.

Figure 2:
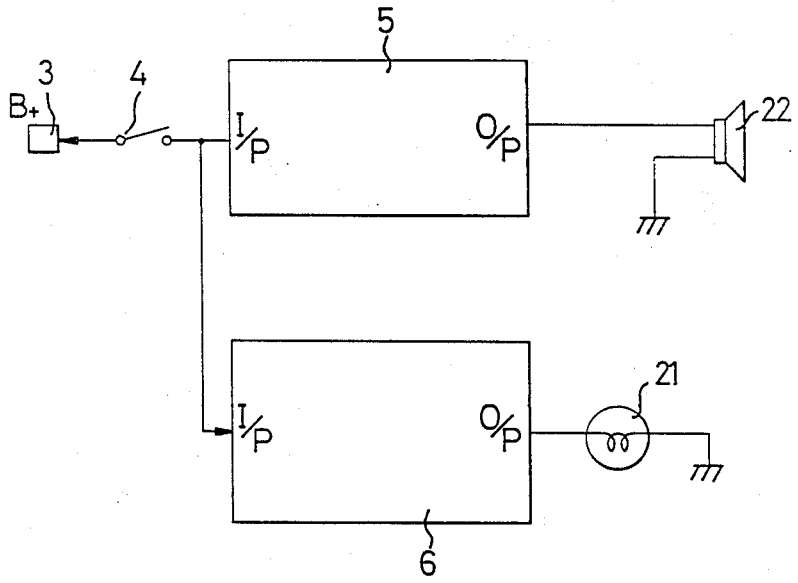
FIG. 2 is a schematic view of the electric circuit of the emergency flashlight of FIG. 1.

Referring to FIG. 2, it can be seen that the user lamp 21 is in series with a flashing circuit 6 which causes it to flash bright bursts of light for short periods of time. This feature lengthens the life of the auxiliary battery 3 while at the same time enhancing the noticeability of the user lamp 21 over the noticeability of a normal continuously burning lamp, since someone far away is more likely to notice a flashing light than a continuously burning light.

Still referring to FIG. 2, it can further be seen that the auxiliary battery 3 powers both a frequency generator 5 and the flashing circuit 6, which are in parallel with each other. Therefore at the same time the auxiliary battery 23 drives the flashing circuit 6 and user lamp 21, it also drives the sounder 22 to emit a beeping or a sounding noise, which preferably is of a high pitch so as to be more noticeable.

The combination of flashing user lamp 21 and sounder 22 can be used to attract any person's attention who is in the area of the lost or stranded user. Of course, the user may choose to use the main lamp 11 of the flashlight only if he is not stranded or in an emergency situation. The advantage of having separate D.C. power sources (batteries) is that the main lamp uses substantially more current than the sounder 22 and flashing user lamp 21. Therefore, even when the main dry cell batteries are used up, the emergency distress signals (i.e. beeping and flashing) can still be used.

Another feature of this invention which can be seen and understood from FIG. 1 is the compass 12. The compass 12 is built into the housing 1 of the flashlight on outer front surface thereof. This feature prevents the user from having to carry a separate compass. Obviously, when lost, a compass would be useful for pointing the user in a desired direction should he desire to go in a certain specific direction.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In a flashlight comprising a housing (1), a main lamp (11), an ON/OFF switch (13), and dry cell batteries, the improvement comprising the combination of:

(a) an enclosed detection box (2) being fixed on an outer front surface of said housing (1); said detection box (2) having a user lamp (21), a sounder (22), an auxiliary battery (23) and a control switch (24) therein; said auxiliary battery (3) driving a frequency generator (5) which in turns causes said sounder (22) to emit a beeping or buzzing noise, said auxiliary battery (3) also driving a flashing circuit (6) which in turn drives said user lamp (21) to flash bright bursts of light for short periods of time, said frequency generator (5) and said flashing circuit (6) being in parallel with each other; and (b) a compass (12) fixed on the outer front surface of said housing (1) for determining the direction in which said flashlight is pointing.

* * * * *